United States Patent [19]

Walker et al.

[11] 4,341,273

[45] Jul. 27, 1982

[54] ROTARY BIT WITH JET NOZZLES

[75] Inventors: Bruce H. Walker, Salt Lake City, Utah; Robijn Feenstra, Rijswijk, Netherlands

[73] Assignee: Shell Oil Company, Houston, Tex.

[21] Appl. No.: 267,957

[22] Filed: May 28, 1981

[30] Foreign Application Priority Data

Jul. 4, 1980 [GB] United Kingdom ..... 8022050

[51] Int. Cl.[3] ..... E21B 10/18; E21B 10/60; E21B 12/06

[52] U.S. Cl. ..... 175/339; 175/312; 175/313; 175/393

[58] Field of Search ..... 175/312, 313, 339, 340, 175/393

[56] References Cited

U.S. PATENT DOCUMENTS

| | | | |
|---|---|---|---|
| Re. 23,416 | 10/1951 | Kinnear | 175/340 X |
| 1,193,468 | 8/1916 | Okell | 175/393 |
| 2,017,834 | 10/1935 | Hummel | 175/393 |
| 2,066,671 | 1/1937 | Catland | 175/339 |
| 2,549,420 | 4/1951 | Camp | 175/339 X |
| 2,562,833 | 7/1951 | True | 175/393X |
| 2,708,566 | 5/1955 | Caldwell | 175/312 X |
| 2,760,158 | 8/1956 | Yancey et al. | 175/339 X |
| 3,131,779 | 5/1964 | Rowley et al. | 175/393 X |
| 3,329,322 | 7/1967 | Neilson | 175/375 X |

*Primary Examiner*—Stephen J. Novosad
*Assistant Examiner*—Joseph Falk

[57] ABSTRACT

A jet rotary drill bit confirming a first strainer element allowing the passage of mud carrying small-sized particles, but preventing relatively coarse particles from passing to the jet nozzles. The first strainer element is self-cleaning and the relatively coarse particles are passed on to a second strainer on which they remain trapped.

13 Claims, 4 Drawing Figures

ROTARY BIT WITH JET NOZZLES

BACKGROUND OF THE INVENTION

The invention relates to a rotary bit for use in drilling boreholes or wells in underground formations. In particular, the invention relates to a rotary bit provided for cutting elements and a plurality of nozzles for discharging liquid, at least some of the nozzles being arranged to have liquid under pressure supplied thereto, thereby forming pressurized liquid jets. These jets either break up the bottom of the hole to deepen the hole (which manner of drilling is often indicated by the expression "hydraulic drilling") or remove the drilling flour or fine earth particles from the cutting elements and/or from the bottom of the hole, which drilling flour results from the mechanical drilling action of cutting elements carried by the bit. Such cutting elements may be mounted on roller cones and consists of cutting teeth, cutting rings, etc., or be mounted directly on the body of the bit and consist of diamonds, abrasive bodies such as the bodies made of materials like those known by the tradename Stratapax, and like elements.

The most effective action of the liquid jets will be obtained by jets originating from liquid nozzles having a relatively small internal diameter (in the order of 2–4 millimeter), over which nozzles a relatively high-fluid pressure difference exists (in the order of 30–150 bar). It will be appreciated that such nozzles that are made of an erosion-resistant material, will be liable to become plugged by particles present in the drilling mud that is being pumped down through the drilling equipment (such as the drill string) to the drill bit.

These particles may be lumps of solid material that has been mixed in powder form at the surface with a liquid for making up the drilling mud. Incomplete mixing will result in the formation of lumps that may partly be broken up by the mud pumps via which the mud is passed down the well, but the remaining lumps will be sieved off from the mud by jet nozzles in the bit, which nozzles will be plugged thereby decreasing the mud flow through the bit and jeopardizing the drilling action. Other particles may be constituted by fragments of the formation, which fragments have passed through damaged parts of the screening trays on the drilling floor, via which trays the drilling mud is returned to the borehole after appropriate treatment thereof. Also, dirt or corrosion products may be detached from the inner wall of the drill string by the mud flow passing therethrough, and be caught at the entrances of the nozzles when the mud passes therethrough.

Further, lost circulation material may be added to the mud flow to fight circulation losses occurring during drilling. These materials sometimes contain lumps or chunks of solid material that cannot pass through the small passages of the fluid nozzles present in the drilling bit.

Clogging of the fluid nozzles of the drilling bit described in U.S. Pat. No. 3,175,629 to D. S. Rowley is prevented by a screening element mounted in the shank of the bit, which screening element prevents relatively large particles present in the mud stream to reach the three fluid nozzles that debouch in the face of the bit. Only part of the mud stream is passed through the screening element, whereas the remaining part passes through a central channel in the shank and the body of the bit to a large-diameter nozzle situated in the centre of the lower end of the bit body. A plurality of choke plates provided with a single central passage of a diameter equal to the diameter of the central nozzle is arranged in the central channel to restrict the flow through the large-diameter central channel in order that a sufficient volume of drilling fluid will pass through the screening element to the small-diameter nozzles. The screening element is self-cleaning, and the particles caught by the screening element are subsequently discharged by the fluid flow passing through the central channel.

A similar arrangement, apart from the choke plates in the central channel, is known from the U.S. Pat. No. 2,293,259 to C. D. Johnson. Part of the mud flow has the relatively large-sized particles filtered therefrom, and is supplied to six nozzles, whereas the remaining unfiltered part of the mud flow is passed through a nozzle of a diameter larger than the diameters of the six nozzles.

Tests carried out with drilling bits have made clear that drilling efficiency will considerably be promoted by the use of liquid jets of extremely high pressure and high velocity. Unfortunately, when raising the pressure of the mud supply to the jet nozzles in the abovementioned prior art bits, large volumes of fluid will pass through the central channel of the bits to the centrally arranged large-sized nozzle without effectively supporting the drilling action of the bit. In the bit of U.S. Pat. No. 3,175,629, this situation might be improved by increasing the number of choke plates in the central channel, but this will lead to a complicated and costly structure of the bit.

SUMMARY OF THE INVENTION

Object of the invention is a drilling bit of relatively simple design for drilling boreholes or wells in subsurface formations, which bit is equipped with nozzles for generating liquid jets of relatively high pressure and relatively small diameter, which jets perform and/or assist the drilling action to be carried out by the bit.

Another object of the invention is a drilling bit with a large number of jet nozzles for generating high pressure, small diameter liquid jets.

The drilling bit according to the invention inclues a body with a central cavity and a shank attached to the body and enclosing a central fluid passage that communicates with the cavity, a first self-cleaning screening element with a plurality of fluid passages sllowing the passage of a predetermined size range of particles carried by a fluid, the element being at least partly mounted in the cavity and dividing the cavity in a first part communicating with a first set of nozzles, and a second part communicating with the central passage of a drill string when the shank of the bit is coupled thereto, said second part being divided in two further parts by a second screening element having a plurality of fluid passages through which coarser particles can pass than through the fluid passages of the first screening element, one of these two further parts communicating with the fluid passages in the first screening element, and the other part communicating with a second set of nozzles that are less in number than the first set of nozzles, the fluid passage through each of the nozzles of the second set being larger than the fluid passage through each of the nozzles of the first set and being at least equal to a fluid passage of the second screening element.

BRIEF DESCRIPTION OF THE DRAWING

The invention will now be described by way of example in more detail with reference to the drawings, wherein.

DESCRIPTION OF A PREFERRED EMBODIMENT

Figure 1:
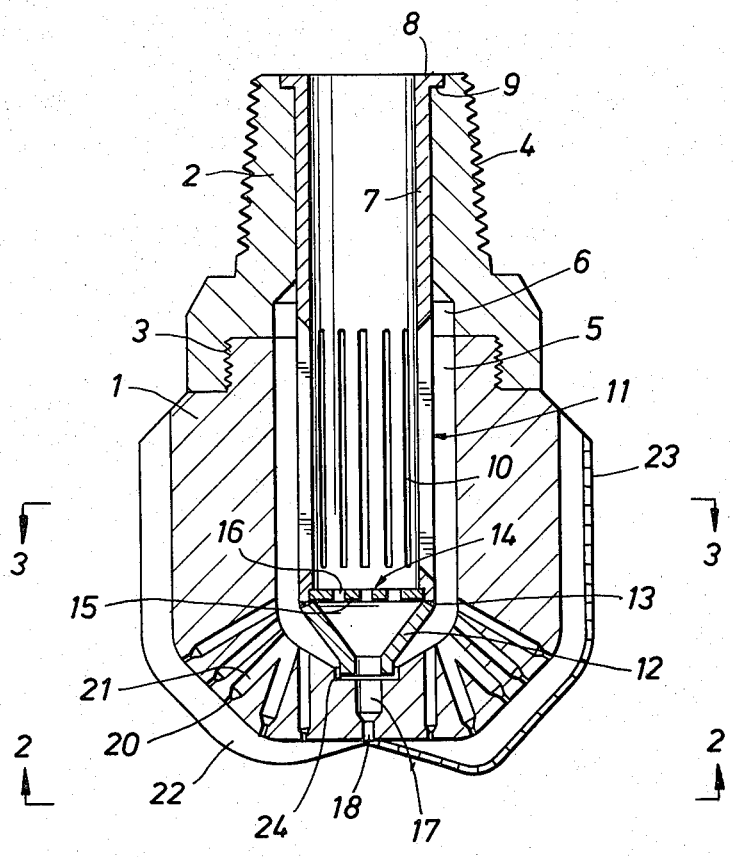
FIG. 1 shows a longitudinal section over a drill bit according to the invention.
Figure 2:
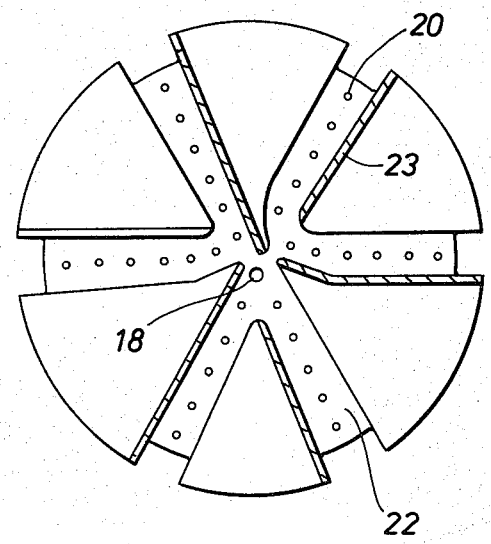
FIG. 2 shows a bottom view (in the direction of arrow II) of the bit of FIG. 1.
Figure 3:
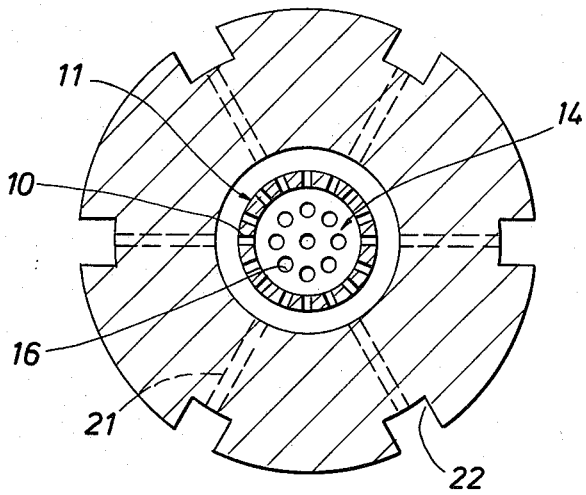
FIG. 3 shows cross-section III—III of the bit of FIG. 1.

The drill bit shown in FIGS. 1, 2 and 3 is of the rotary type and suitable for drilling in relatively hard formations. The body 1 of the bit is connected to a shank 2 by means of a screw thread 3. The shank 2 is provided with a screw thread 4 forming a tool joint for connecting the bit to the lower end of a (not shown) drill string. A cavity 5 is present in the body 1, which cavity communicates with the central fluid passage 6 in the shank 2. This passage 6 is lined by the upper part of the tube 7, this tube carrying at the upper end thereof a flange 8 cooperating with a seat 9 in the upper end of the shank 2. The lower part of the tube 7 is provided with fluid passages 10 forming the first screening element 11. A frusto conical conduit 12 is welded (by weld 13) to the lower end of the tube 7, and the second screening element 14 formed by a disc-shaped plate 15 provided with fluid passages 16 is clamped between the tube 7 and the conduit 12.

The lower end of the conduit 12 communicates with the channel 17 in the body 1, which channel leads to the nozzle 18 that debouches in the face of the bit near the centre thereof.

Apart from the nozzle 18, jet nozzles 20 are provided in the body 1, each of these nozzles communicating with a channel 21 in the body 1 of the bit. All these channels 21 communicate with the cavity 5 in the body 1. The jet nozzles 20 have a diameter smaller than the diameter of the central nozzle 18. The jet nozzles debouch in the waterways 22 that are arranged in the face of the bit (see in particular FIGS. 2 and 3).

Cutting or scraping means 23 for deepening a hole that is being drilled by the bit in a subsurface formation are mounted alongside one of the walls of each of the waterways 22. The cutting means may be formed by an abrasive resistant material, such as the material known under the trade mark "Stratapax" which material is marketed by General Electric.

At least those parts of the bit that are subjected to erosive action of drilling fluid that is being circulated through the drill string (not shown), the bit and the borehole during drilling operations, consist of an erosion-resistant material such as sintered tungsten carbide particles. Various types of such erosion-resistant materials are known per se and are therefore not described in detail. The same applies for the manner wherein such materials are applied in the design of the bit.

The size of the fluid passages 10 of the first screening element 11 is such that only those particles in the mud flow are allowed to pass through the screen that will also pass through the channels 21 and the nozzles 20. Thus, at least part of the particles of a predetermined size range are allowed to pass through the screening element 11 and the jet nozzles 20, whereas the remaining part of the particles of this predetermined size range and the particles larger than said size range are carried by the fluid flow to the second screening element 14. The openings 16 of this latter screening element are of such a size, that the particles carried by the flow will pass therethrough. Since further the size of the fluid passages through the conduit 12, the channel 17 and the central nozzle 18 is at least equal to the fluid passage of one of the fluid passages 16 of the second screening element 14, the mud flow carrying the particles will pass unimpedely therethrough.

It will be appreciated that as long as the drilling mud that is passed through the (not shown) drill string to the bit contains only particles smaller than the particles that can pass through the openings 16 of the screening element 14, no obstruction of any of the fluid passages through the bit will take place. The ratio between the flow resistance met by the mud flow passing through the first screening element 11, the cavity 5, the channels 21 and the jet nozzles 20, and the flow resistance met by the fluid flow passing through the second screening element 14, the conduit 12, the channel 17 and the nozzle 18 is chosen such that the major part of the volume of drilling mud supplied to the bit will pass through the jet nozzles 20, whereas only a minor part of this volume will leave the bit via the central nozzle 18. As will be explained hereinafter, the presence of the second screening element 14, allows the application of a central nozzle 18 of the relatively small size which results in only a relatively small flow of mud through the nozzle 18 and the relatively large flow of mud through the jet nozzles 20, thereby forming high velocity mud jets issuing from the nozzles 20, which jets considerably support the efficiency of the drilling action of the cutting elements 23.

Thus, the nozzle 18 allows the passage of particles that would obstruct the jet nozzles 20, which particles are therefor screened by the first screening element from the mud flow passing through the bit. The particles caught by the first screening element 11 are removed from the screen by that part of the mud stream that flows to the nozzle 18. These particles will pass through the openings 16 of the second screening element 14 and the conduit 12, the channel 17 and the nozzle 18.

Occasionally, however, larger-sized particles will be present in the mud flow, which particles would obstruct the nozzle 18 if the second screening element 14 was not present. Such particles, however, will be screened from the mud flow passing through the second screening element 14, and since this element is provided with nine fluid passages 16, eight particles of a size that would obstruct the passage through the nozzle 18 may be present in the mud flow and be caught by the second screening element 14 before the fluid flow passing through the screening element 14 to the nozzle 18 will be cut off. If this happens, the total mud flow will pass through the openings 10 of the first screening element 11, which in the absence of the self-cleaning action thereof by the mud flow towards the second screening element 14, will soon be plugged. The drilling operation should then be interrupted, and the bit should be retrieved to the surface for cleaning the screening elements 11 and 14. However, this will only rarely occur since the number of oversized particles that are passed involuntarily to the bit by the mud flow is rather restricted.

It will be appreciated that the integral construction of the two screening elements 11 and 14 allows an easy cleaning and replacement of these elements. The tube 7 may be clamped in position by the cooperation of the flange 8 thereof with the seat 9 and the (not shown) lower part of the drill collar section or sub that is screwed to the screw thread 4 of the bit. However, other means of locking the tube in the required position may also be applied.

Reference is now made to the annular slit 24 between the lower end of the conduit 12 and the body 1. The width of this slit should be sufficiently small to minimize the passage of fluid flow through the slit if a high fluid pressure difference exists over the slit during drilling operations. However, there is no objection against the use of an O-ring or other sealing element to close off this slit against fluid passage therethrough.

In drilling holes by means of the rotary bit shown in FIGS. 1–3, a drilling mud should be used containing particles that can all pass through the openings 16 of the second screening element 14 and consequently also through the central nozzle 18 that has a diameter at least equal to the diameter of the openings 16. The dimensions of these particles may further include a size range that is sufficiently small to allow particles of this size range to pass through the openings 10 of the first screening element 11 (and consequently through the jet nozzles 20).

Particles of a size preventing passage thereof through the central nozzle 18 may occasionally be present in the mud. In the absence of the second screening element 14, a single particle of this size would obstruct the nozzle 18, thereby impeding the self-cleaning action of the first screening element 11. This element will then become plugged and prevent mud from flowing to the jet nozzles 20. The scraping elements will no longer be cooled and cleaned, and the drilling operation is to be interrupted to prevent damage of the bit. The bit is then to be retrieved from the hole for cleaning the screening elements before the drilling operation can be resumed. In the bit according to the invention, however, the presence of the second screening element 14 prevents an over-sized particle carried by the mud flow to reach the nozzle 18, since such particle is screened from the flow by the element 14, thereby obstructing one of the openings 16 in this element. The mud flow, however, continues to pass through the remaining openings 16, and the drilling operation will not be interrupted. Since there are several openings 16 in the screening element 14, a plurality of oversized particles can be allowed to be present in the mud flow before the drilling operation is to be discontinued for cleaning the bit.

Nine openings 16 are present in the screening element 14, but it will be appreciated that other members of openings may also be used, as long as the periods between successive cleaning actions of the screening elements are sufficiently long when the bit is being used in a drilling operation. Preferably, at least five openings 16 are present, whereas the maximum amount of openings is dictated by the size of the bit.

Figure 4:
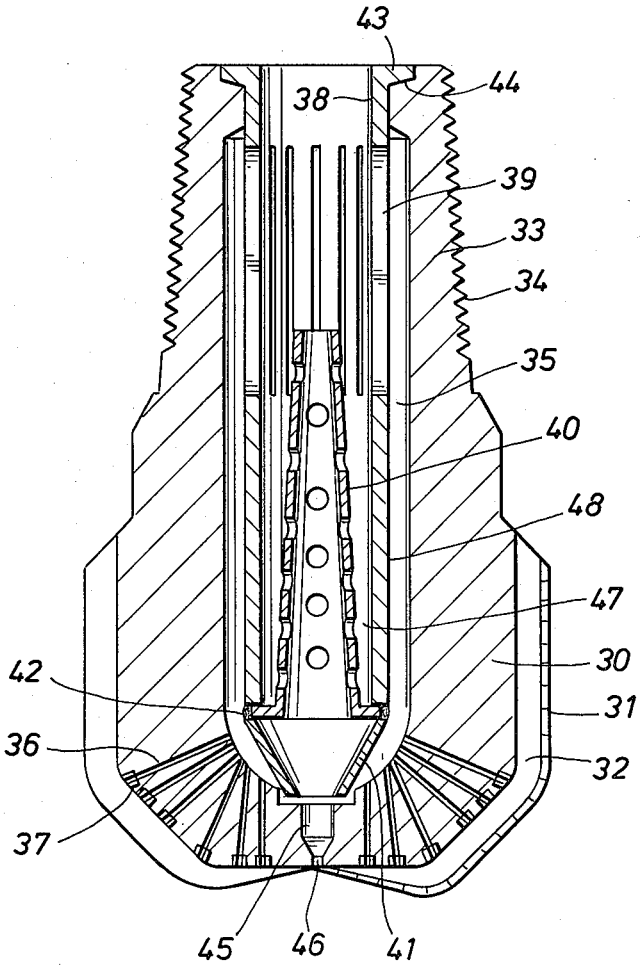
FIG. 4 shows a longitudinal section over a drill bit according to the invention, comprising a set of screening elements other than the set of screening elements of the bit shown in FIG. 1.

FIG. 4 of the drawings shows a longitudinal section over a drill bit according to the invention, which bit is equipped with a set of screening elements allowing a large amount of over-sized particles to be present in the drilling mud supplied to the bit, before the second screening element becomes clogged and the bit is to be lifted from the hole for cleaning. The bit shown in FIG. 4 comprises a body 30 with cutting elements 31 mounted at one side of mud channels or waterways 32. The shank 33 of the bit is provided with a conical screw thread 34 for coupling the bit to the lower end of a (not shown) drill string. The passage 35 forming the central channel through the shank 33 and the cavity within the bit body 30 communicates with channels 36 leading to nozzles 37. A set 38 of screening elements is arranged within the passage 35. This set consists of a first screening element 39 and a second screening element 40. Element 39 consists of a slotted cylindrical tube, whereas element 40 is constituted by an apertured hollow cylindrical body that has the apex thereof pointing in the direction of the upper end of the shank 33.

The elements 39 and 40, and the outlet tube 41 are interconnected by a weld 42. The upper end of the set 38 of screening elements is provided with a flange 43 cooperating with a seat 44. The lower end of the set 38 communicates with a channel 45 that debouches in the nozzle 46 arranged near the centre of the lower side of the bit body. The arrangement of the cutting elements 31, the waterways 32, the nozzles 37 and 46 is the same as the arrangement of the corresponding elements of the bit of FIG. 1 and for this purpose reference is also made to FIG. 2 showing the bottom view of the bit of FIG. 1.

The volume of high-pressure drilling mud that is supplied to the bit of FIG. 4 during operation thereof in a hole, will for the greater part pass through the slots of the first screening element 39, and form high-pressure liquid jets that leave the nozzles 37 at high velocity. The size of the slits of the screening element 39 are chosen such that the particles present in the mud flow passing through the slots of the element 39 will also pass through the nozzles 37 without obstructing the passages therethrough. Particles of larger size ranges are caught by the first screening element 39. This screening element 39 is continuously being cleaned by that part of the mud flow that passes to the nozzle 46 via the perforations of the second screening element 40, the conduit 41 and the channel 45. The size of the perforations of the second screening element 40 is chosen such that these larger sizes of the particles in the mud can readily pass therethrough. Since the size of the nozzle 46 is at least equal to the size of the individual perforations, these larger sizes of the particles will also pass through the nozzle 46 without obstructing the passage therethrough.

However, when extremely large particles are inadvertently present in the mud flow that should pass through the bit, these particles will be caught by the second screening element 40 and are thus prevented from obstructing the nozzle 46. If a plurality of such particles is present in the flow, an equal number of perforations will become obstructed. The perforations may—at least partly—be cleaned by stopping the mud flow and creating a monetary reverse flow of mud through the nozzle 46, the channel 45, the conduit 41 and the perforations of the second screening element 40. The particles will then be washed from the perforations and sink to the lower part of the space 47 between the inner wall of the tubular element 48 of the set 38 of screening elements and the outer wall of the second screening element 40. When resuming the normal mud circulation, these particles will remain in place, thereby allowing part of the mud flow to pass over the slits of the first screening element 39, thereby cleaning this element such that the major part of the mud flow is allowed to pass to the jet nozzles 37. Additional oversized particles that are inadvertently present in the mud flow supplied to the bit will then be caught by the second screening element 40, which may from time to time be cleaned by the monetary revers and circulation referred to above. When the space 47 around the second screening element 40 is fully filled with over-sized particles, the drill bit should be lifted to the surface for removal of said particles from the space 47.

The invention is not restricted to the type of bit shown in the drawing, but may be applied to any other type of rotary bit wherein the mud flow passing therethrough should form high-pressure, high-velocity fluid jets. Thus, apart from finding useful application in diamond bits or other types of bits performing the drilling action by means of scraping elements, the invention may also be applied in roller bits, such as roller cone bits, disc bits, etc.

When applying the set of screening elements in a bit provided with three roller cones carrying cutting elements, and three fluid discharge nozzles, two of these nozzles are then designed as a high-velocity jet nozzle of relatively small internal diameter, whereas the third nozzle is of a larger internal diameter. The arrangement is such, that the mud flow passing through the first screening element will also pass through the two jet nozzles of relatively small internal diameter. The remaining part of the mud flow supplied to the bit will pass through the second screening element and subsequently through the third nozzle having a larger internal diameter than the internal diameter of each of the jet nozzles.

Also, if desired, the two jet nozzles may be replaced by three jet nozzles that are evenly distributed between the three roller cones, whereas the nozzle having a relatively large diameter is placed in or near the centre of the lower side of the bit body.

When applying the invention to a bit provided with cutting elements mounted directly on the body of the bit (such as is the case with diamond bits) the jet nozzles adapted to form high-pressure, high-velocity liquid jets may debouch either in the waterways such as shown in the drawings, but also outside the waterways (if these are present) or at any other region of the bit face. Between 5–30 jet nozzles may then be present.

Thus, between 2 and 30 jet nozzles may be used in the first set of nozzles of bits according to the invention, which first set of nozzles have liquid supplied thereto via the first screening element. The internal diameters of these nozzles are between 2 and 9 millimeter.

In the majority of bit designs according to the invention, a single nozzle of relatively large-size diameter will be sufficient for the passage of the mud flow that has passed through the second screening element. However, there is no objection to use a larger number of these nozzles, provided that the size thereof is chosen such that only a minor part of the total mud flow supplied to the bit will pass therethrough.

When a single nozzle of relatively large diameter is used in the second set of nozzles that have the liquid supplied thereto via the second screening element, this nozzle is not necessarily situated in or near the centre of the lower side of the bit. Any other place suitable for the purpose may be chosen as well for the location of this nozzle.

The second screening element may have at least five fluid passages. The passages may be circular and have a diameter between 8 and 12 millimeter.

Each of the nozzles of the second set of nozzles via which the mud passing through the second screening element is discharged from the bit, may be closed off temporarily with a plug (such as a wooden plug or a wax plug) during running in of the bit in a borehole in order to prevent large-sized particles from entering the cavity of the bit via the nozzles. In particular, such plugging off is desirable when the diameter of these nozzles is larger than the diameter of the apertures of the second screening element. The plug is removed by the pressure of the mud supplied to the bit when drilling operation is initiated. In this manner, an assembly of large-size particles in the cavity is prevented, which would obstruct the nozzle when the mud starts flowing through the bit on resuming drilling.

It will be appreciated that although an integral unit comprising two screening elements is shown in the drawings, this unit may be replaced by two separate parts each including one of the screening elements, one or both of these parts being permanently mounted in the bit. The first screening element should always be of the self-cleaning type, wherein a flow of fluid passing along the screening surface will remove those particles from this surface that have been caught thereby during the screening action. Although the first screening element in both embodiments shown in the drawings consists of a cylindrical slotted wall, the invention is not restricted to this type of screening element. If desired, the cross-section of the wall may deviate from a cylinder, and the passage ways through the wall may be circular instead of slotted.

In an alternative embodiment of the invention, the second screening element shown in FIG. 4 of the drawings may be sylindrically shaped instead of frusto-conically. The top of the cylinder may be formed by a plate member provided with suitable sieve openings. The sieve openings of this second screening element may be of other configuration than shown in FIG. 4, e.g. be slit-shaped instead of circular.

The jet nozzles as well as the large-size nozzle may be directly formed in the erosion-resistant material of the body of the bit. If desired, however, special nozzle bodies of erosion-resistant material may be mounted on the body of the bit, which nozzle bodies communicate either directly with the cavity in the body of the bit, or indirectly via channels or conduits.

We claim as our invention:

1. Rotary bit with cutting elements and a plurality of liquid-discharger nozzles for drilling hole in an underground formation, the bit including a body with a central cavity and a shank attached to the body and enclosing a central fluid passage that communicates with the cavity, a first self-cleaning screening element with a plurality of fluid passages allowing the passage of a predetermined size range of particles carried by a fluid, the element being at least partly mounted in the cavity and dividing the cavity in a first part communicating with a first set of nozzles, and a second part communicating with the central passage of a drill string when the shank of the bit is copuled thereto, said second part being divided in two further parts by a second screening element having a plurality of fluid passages through which coarser particles can pass than through the fluid passages of the first screening element, one of these two further parts communicating with the fluid passages in the first screening element, and the other part communicating with a second set of nozzles that are fewer in number than the first set of nozzles, the fluid passage through each of the nozzles of the second set being larger than the fluid passage through each of the nozzles of the first set and being at least equal to a fluid passage of the second screening element.

2. The rotary bit according to claim 1, wherein the fluid passages through the nozzles of the first set are circular and have a diameter between 2 and 9 millimeters.

3. The rotary bit according to claim 1 or 2, wherein the first set of nozzles consists of two nozzles, and the cutting elements are mounted on three roller cones.

4. The rotary bit according to claim 1 or 2, wherein the first set of nozzles consists of between 5 and 30 nozzles and the cutting elements are carried directly by the body of the bit.

5. The rotary bit according to claim 3, wherein the second set of nozzles consists of a single nozzle.

6. The rotary bit according to claim 1, wherein the second screening element comprises at least five fluid passages.

7. The rotary bit according to claim 1, wherein the fluid passages of the second screening element are circular and have a diameter between 8 and 15 millimeters.

8. The rotary bit according to claim 1, wherein the first screening element is formed by slit-shaped fluid passages in the wall of a tube.

9. The rotary bit according to claim 1, wherein the second screening element consists of an apertured element closing off the passage through the tube.

10. The rotary bit according to claim 9, wherein the apertured element is a substantially flat plate.

11. The rotary bit according to claim 9, wherein the apertured element is conically shaped and has the apex thereof pointing in the direction of the central passage of a drill string when the shank of the bit is coupled thereto.

12. The rotary bit according to claim 9, wherein the apertured element is cylindrically shaped.

13. The rotary bit according to claim 11 or 12, wherein the apertures consist of slits.

* * * * *